US005168705A

United States Patent [19]

Hirata et al.

[11] Patent Number: 5,168,705

[45] Date of Patent: Dec. 8, 1992

[54] HYDRAULIC DRIVE SYSTEM

[75] Inventors: Toichi Hirata, Ushiku; Hideaki Tanaka, Tsuchiura; Kazunori Nakamura, Ibaraki; Hideshi Koiwai, Toda; Yoneaki Takahashi, Ohmiya, all of Japan

[73] Assignees: Hitachi Construction Machinery Co., Ltd.; Kayaba Industry Co., Ltd., both of Tokyo, Japan

[21] Appl. No.: 661,600

[22] Filed: Feb. 28, 1991

[30] Foreign Application Priority Data

Mar. 5, 1990 [JP] Japan ..... 2-53325

[51] Int. Cl.[5] ..... F16D 31/02

[52] U.S. Cl. ..... 60/452; 91/436; 91/444; 91/448; 91/463; 137/596.13

[58] Field of Search ..... 137/596, 596.13; 60/452, 484, 445, 427; 91/444, 448, 462, 463, 436, 446

[56] References Cited

U.S. PATENT DOCUMENTS

| | | | |
|---|---|---|---|
| 3,482,600 | 12/1969 | Hodgson | 91/436 X |
| 3,746,040 | 7/1973 | Paul | 91/436 X |
| 4,089,167 | 5/1978 | Budzigh | 60/445 X |
| 4,174,613 | 11/1979 | Budzich | 60/427 |
| 4,222,409 | 9/1980 | Budzich | 137/596.13 |
| 4,249,570 | 2/1981 | Budzich | 91/436 X |
| 4,267,860 | 5/1981 | Budzich | 137/596.13 X |
| 4,293,000 | 10/1981 | Budzich | 91/436 X |
| 4,336,687 | 6/1982 | Morgan | 60/452 X |
| 4,463,558 | 8/1984 | Miller et al. | 60/427 X |
| 4,470,260 | 9/1984 | Miller et al. | 60/427 X |
| 4,870,819 | 10/1989 | Walzer | 60/427 X |

FOREIGN PATENT DOCUMENTS

| | | |
|---|---|---|
| 262098 | 3/1988 | European Pat. Off. . |
| 63-83803 | 5/1987 | Japan . |
| 2134187 | 8/1984 | United Kingdom . |

*Primary Examiner*—Edward K. Look
*Assistant Examiner*—Todd Mattingly
*Attorney, Agent, or Firm*—Fay, Sharpe, Beall, Fagan, Minnich & McKee

[57] ABSTRACT

A flow control valve has a first variable restrictor to control a flow rate of a hydraulic fluid supplied from a hydraulic fluid supply line to a hydraulic actuator and a second variable restrictor to control a flow rate of the hydraulic fluid discharged from the hydraulic actuator to a hydraulic fluid return line. A pressure compensating valve holds constant a differential pressure across the first variable restrictor, and a recovery circuit having a recovery line has a check valve that allows flow of the hydraulic fluid only toward the supply line. The recovery circuit receives at least part of the hydraulic fluid discharged from the hydraulic actuator and returns it to the supply line at a portion between the pressure compensating valve and the first variable restrictor through the recovery line upon controlling of the discharged flow rate by the second variable restrictor to thereby recover the discharged hydraulic fluid. A third variable restrictor disposed in the return line at a portion downstream of the second variable restrictor controls the recovery pressure of the hydraulic fluid returned to the supply line, and its restriction amount is changed dependent upon an input amount of the flow rate control valve.

3 Claims, 5 Drawing Sheets

HYDRAULIC DRIVE SYSTEM

BACKGROUNd OF THE INVENTION

The present invention relates to a hydraulic drive system for hydraulic machines such as hydraulic excavators, and more particularly to a hydraulic drive system equipped with a recovery circuit for returning at least part of a hydraulic fluid discharged from a hydraulic actuator, to a supply line.

A well-known one of conventional hydraulic drive systems with recovery circuits is described in JP, A, 63-83808. This conventional system comprises a hydraulic pump, a reservoir, a hydraulic actuator, a hydraulic fluid supply line connected to the hydraulic pump, a hydraulic fluid return line connected to the reservoir, a flow control valve having a first variable restrictor to control a flow rate of the hydraulic fluid supplied from the supply line to a hydraulic actuator and a second variable restrictor to control a flow rate of the hydraulic fluid discharged from the hydraulic actuator to the return line, a pressure compensating valve disposed in the supply line to hold constant a differential pressure across the first variable restrictor, and a recovery circuit including a recovery line connecting the return line to the supply line at a portion between the pressure compensating valve and the first variable restrictor, a check valve allowing only a flow of the hydraulic fluid toward the supply line, and a fixed restrictor. During a meter-in control mode to control the flow rate of the hydraulic fluid supplied to the actuator by the first restrictor as effected, for example, when an arm is crowded for digging, the pressure compensating first variable restrictor, whereby the flow rate of the supplied, hydraulic fluid is controlled to a predetermined value dependent on an restriction amount of the first variable restrictor.

During a meter-out control mode to control the flow rate of the hydraulic fluid discharged from the actuator by the second restrictor as effected, for example, when an arm is caused to descend in the direction of gravity by an external load under speed control, at least part of the hydraulic fluid discharged from the hydraulic actuator is returned through the recovery line to the supply line at the portion between the pressure compensating valve and the first variable restrictor for recovering the flow rate of the discharged hydraulic fluid.

However, such a recovery circuit of the conventional system has suffered from a problem below.

In an attempt of moving the load in a very small amount during a meter-out control mode to control the flow rate of the hydraulic fluid discharge from the actuator, it is required to finely operate the flow control valve for making small respective openings of the first and second variable restrictors. When the openings of the first and second variable restrictors are reduced in the conventional system with the recovery circuit, the opening of the second variable restrictor becomes smaller than an opening the restrictor in the recovery circuit because the latter is set fixed. Further, the recovery line is directly connected to the return line at a portion between a discharge port of the actuator and the second variable restrictor such that a discharge pressure on the rod side of the actuator directly acts on the recovery circuit. Therefore, the pressure produced by the second variable restrictor is established, as a discharge pressure, on the rod side of the actuator. Thus, the produced pressure acts as a discharge pressure on the recovery circuit, so that the hydraulic fluid discharged from the actuator flows into the supply line through the restrictor in the recovery line. The hydraulic fluid led into the supply line is then supplied to the actuator through the first variable restrictor. At this time, the opening of the first variable restrictor is also smaller than the opening of the fixed restrictor in the recovery circuit. Therefore, the pressure of the hydraulic fluid having passed through the restrictor in the recovery line is lowered just a little from the pressure in the discharge line to maintain a relatively high pressure, and this relatively high pressure acts on the upstream side of the first variable restrictor. On the other hand, the pressure in the downstream side of the first vairable restrictor is at a very low level during the meter-out control mode. Consequently, the pressure compensating valve is closed and the hydraulic pump fails to supply the hydraulic fluid.

Meanwhile, with the foregoing connection arrangement of the actuator, because the hydraulic fluid is supplied to the bottom side of a cylinder and is discharged from the rod side thereof, the flow rate of the discharged hydraulic fluid is less than that of the supplied hydraulic fluid by an extent corresponding to the ratio of area between the bottom and rod sides of the cylinder. As a result, even if the flow rate of the discharged hydraulic fluid is totally recovered and supplied to the actuator, the flow rate of the supplied hydraulic fluid will become insufficient and cavitation will occur in case of the pressure compensating valve being closed.

An object of the present invention is to provide a hydraulic drive system equipped with a recovery circuit which can recover at least part of the flow rate of a discharged hydraulic fluid during fine operation of a fluid control valve under a meter-out control mode, without causing cavitation.

SUMMARY OF THE INVENTION

To achieve the above object, the present invention provides a hydraulic drive system comprising a hydraulic fluid supply source having at least one hydraulic pump, a reservoir, at least one hydraulic actuator, a hydraulic fluid supply line connected to said hydraulic fluid supply source, a hydraulic fluid return line connected to said reservoir, a flow control valve having a first variable restrictor to control a flow rate of a hydraulic fluid supplied from said supply line to said hydraulic actuator and a second variable restrictor to control a flow rate of the hydraulic fluid discharged from said hydraulic actuator to said return line, a pressure compensating valve disposed in said supply line to hold constant a differential pressure across said first variable restrictor, and a recovery circuit including a recovery line having a check valve allowing only a flow of the hydraulic fluid toward said supply line, for receiving at least part of the hydraulic fluid discharged from said hydraulic actuator and returning it to said supply line at a portion between said pressure compensating valve and said first variable restrictor upon controlling of the discharged flow rate by said second variable restrictor to thereby recover the discharge hydraulic fluid, wherein the recovery circuit further includes a third variable restrictor for controlling a recovery pressure of the hydraulic fluid returned to said supply line, and means for controlling an amount of restriction of said third variable restrictor dependent upon an input amount of said flow rate control valve.

Preferably, the third variable restrictor is disposed in the return line at a portion downstream of the second variable restrictor, and the recovery line is connected to the return line at a portion between the second variable restrictor and the third variable restrictor.

Preferably, the third variable restrictor is incorporated in the flow control valve along with the first variable restrictor and the second variable restrictor.

Preferably, the hydraulic pump is of the variable displacement type, and the hydraulic fluid supply source includes a load sensing regulator for controlling a delivery rate of the hydraulic pump such that a delivery pressure of the hydraulic pump is held higher by a fixed value than a load pressure of the hydraulic actuator.

In the present invention thus arranged, the third variable restrictor for controlling the recovery pressure is dispossed in the recovery circuit and operated in accordance with the input amount of the flow control valve, whereby as openings of the first and second variable restrictors are reduced, so is the opening of the third variable restrictor in a fine operation of the flow control valve during a meter-out control mode. The recovery pressure is controlled correspondingly so that at least part of the flow rate of the discharged hydraulic fluid can be recovered without causing cavitation.

Particularly, by providing the third variable restrictor in the return line at a portion downstream of the second variable restrictor and connecting the recovery line to the return line at a portion between the second variable restrictor and the third variable restrictor, the recovery line is connected to the discharge side of the actuator through the second variable restrictor. Therefore, the discharge pressure of the actuator will not directly act on the recovery line, but the pressure lowered after passing through the second variable restrictor acts on the recovery line. As a result, the pressure upstream of the first variable restrictor will not be raised and the pressure compensating valve can be properly operated.

In addition, the third variable restrictor of the recovery circuit thus arranged is changed in its restriction amount in combined relation to the flow control valve. Accordingly, when the flow control valve is finely operated during the meter-out control mode, the opening of the third variable restrictor is reduced as with the openings of the first and second variable restrictors, and this combined action of the third variable restrictor ensures the recovery pressure necessary for recovery function. More specifically, supposing the opening of the third variable restrictor be fixed in fine operation of the flow control valve, the opening of the second variable restrictor would be smaller than that of the third variable restrictor and, therefore, the third variable restrictor would fail to function as a restrictor. Thus, the pressure necessary for recovery could not be produced in the return line between the second variable restrictor and the third variable restrictor. In contrast, by reducing the opening of the third variable restrictor in combined relation to the opening of the second variable restrictor, the third variable restrictor always functions as a restrictor to secure the adequate recovery pressure.

Thus, by properly operating the pressure compensating valve and securing the adequate regenerated pressure, the flow rate of the discharged hydraulic fluid can be recovered without causing cavitation.

Although there is a problem of the hydraulic pump causing saturation in the case where the hydraulic pump is of the variable displacement type and the hydraulic fluid supply source includes a load sensing regulator, the hydraulic pump is made less likely to cause saturation through recovery of the flow rate of the discharged hydraulic fluid. As a result, operability in the combined operation can be improved while securing high economic efficiency due to the load sensing control.

DESCRIPTION OF THE PREFERRED EMBODIMENT

Hereinafter, one embodiment of the present invention will be described with reference to FIG. 1 through 6. In this embodiment, the present invention is applied to a hydraulic drive system of a hydraulic excavator.

Figure 1:
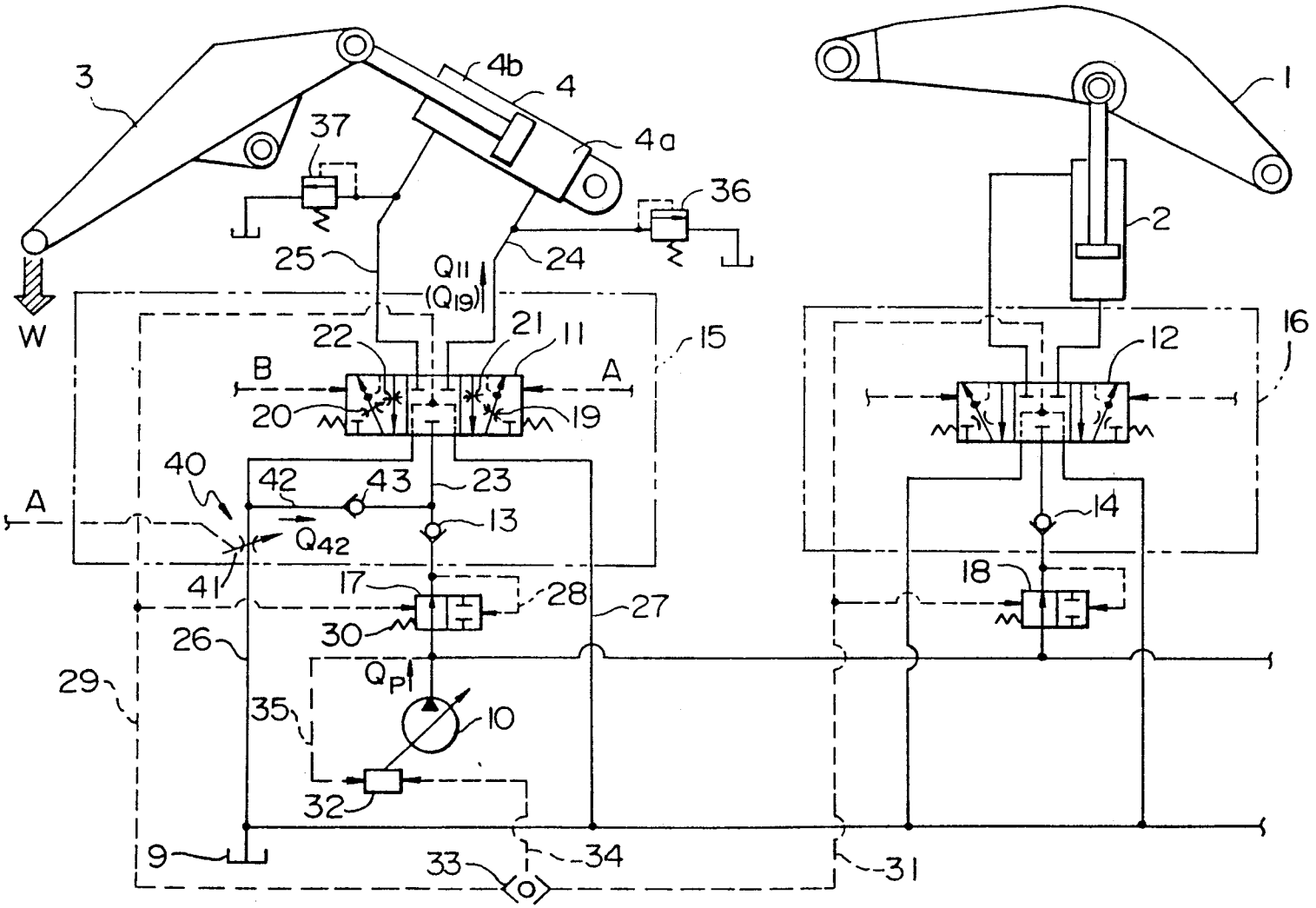
FIG. 1 is a hydraulic circuit diagram of a hydraulic drive system according to one embodiment of the present invention.

In FIG. 1, a hydraulic drive system of this embodiment has a boom cylinder 2 for driving a boom 1 of a hydraulic excavator and an arm cylinder 4 for driving an arm 3. The boom cylinder 2 and the arm cylinder 4 are driven with a hydraulic fluid delivered from a hydraulic pump 10 of variable displacement type which is in turn driven by a prime mover (not shown). Between the hydraulic pump 10 and each of the boom cylinder 2 and the arm cylinder 4, there are respectively disposed a valve apparatus 15, 16 including a flow control valve 11, 12 and a check valve 13, 14, and a pressure compensating valve 17, 18 for holding constant a differential pressure across the flow control valve 11, 12.

In the valve apparatur 15, a pilot pressure A or B is applied from a pilot valve, operated by a control lever (not shown), to the flow control valve 11 to move it from a neutral position. Depending on the direction and amount of input from the control lever, first and second meter-in variable restrictors 19, 20 and first and second meter-out variable restrictors 21, 22, all provided in the flow control valve 11, are changed in their amounts of restriction to thereby control the direction and speed of drive of the arm cylinder 4.

More specifically, when the pilot pressure A is applied, the flow control valve 11 is shifted to a right-hand position, as viewed in the drawing, so that a supply line 23 of the hydraulic fluid connected to the hydraulic pump 10 is communicated through the first meter-in variable restrictor 19 with a work line 24 connected to a bottom chamber **4*a* of the arm cylinder 4, causing the work line 24 to function as a supply line. Simultaneously, a work line 25 connected to a rod chamber 4*b* of the arm cylinder 4 is communicated through the first meter-out variable restrictor 21** with a first return line 26 connected to a reservoir 9, causing the work line 25 to function as a return line. With such a circuit arrangement, during a meter-in control mode, the hydraulic fluid delivered from the hydraulic pump 10 is supplied to the bottom chamber 4a of the arm cylinder 4 so that the arm cylinder 4 is driven in the direction of extension at a speed dependent on the restriction amount of the variable restrictor 19 and, during a meter-out control mode, the hydraulic fluid in the rod chamber 4b of the arm cylinder 4 is discharged under the action of a load W, for example, so that the arm cylinder 4 is driven in the direction of extension at a speed dependent on the restriction amount of the variable restrictor 21.

On the other hand, when the pilot pressure B is applied, the flow control valve 11 is shifted to a left-hand position, as viewed in the drawing, so that the supply line 23 is communicated through the second meter-in variable restrictor 20 with the work line 25, causing the work line 25 to function as a supply line. Simultaneously, the work line 24 is communicated through the second meter-out variable restrictor 22 with a second return line 27 connected to the reservoir 9, causing the work line 24 to function as a return line. With such a circuit arrangement, during a meter-in control mode, the hydraulic fluid delivered from the hydraulic pump 10 is supplied to the rod chamber 4b of the arm cylinder 4 so that the arm cylinder 4 is driven in the direction of contraction at a speed dependent on the restriction amount of the variable restrictor 20 and, during a meter-out control mode, the hydraulic fluid in the bottom chamber 4a of the arm cylinder 4 is discharged under the action of external force, for example, so that the arm cylinder 4 is driven in the direction of contraction at a speed dependent on the restriction amount of the variable restrictor 22.

The check valve 13 is disposed in the supply line 23 between the pressure compensating valve 17 and the flow control valve 11 to prevent the hydraulic fluid from flowing reversely.

The pressure compensating valve 17 is disposed in the supply line 17 between the hydraulic pump 10 and the flow control valve 11, and operates so as to hold the differential pressure across the variable resistor 19 or 20 almost constant during the meter-in control mode. More specifically, the pressure compensating valvue 17 is subjected to, in the valve-closing direction, an inlet pressure of the flow control valve 11 introduced through a pilot line 28 and, in the valve-opening direction, an outlet pressure of the flow control valve 11, i.e., a load pressure of the arm cylinder 4, which is detected by a load line 29 through the flow control valve 11. The pressure compensating valve 17 also includes a spring 30 acting in the valve-opening direction. With such an arrangement, the differential pressure across the variable restrictor 19 or 20 is controlled to be held at a setting value determined by the force of the spring 30. As a result, a flow rate Q11 of the hydraulic fluid passing through the flow control valve 11 takes a value proportional to the opening of the variable restrictor 19 or 20 without being affected by fluctuations in the delivery pressure of the hydraulic pump 10 or the load pressure of the arm cylinder 4, thereby enabling precise speed control of the arm cylinder 4.

The valve apparatus 16 and the pressure compensating valve 18 provided in the boom cylinder 2 also have the same arrangement as above. A load pressure of the boom cylinder 2 is detected by a load line 31 through the flow control valve 12.

The hydraulic pump 10 is provided with a pump regulator 32 adapted to control the delivery rate, for the purpose of so-called load sensing control, such that the pump delivery pressure is kept higher by a fixed differential pressure than higher one of the load pressures of the boom cylinder 2 and the arm cylinder 4, i.e., a maximum load pressure. More specifically, higher one of the load pressure of the arm cylinder 4 detected by the load line 29 and the load pressure of the boom cylinder 2 detected by the load line 31 is selected as a maximum load pressure by a higher-pressure select valve 33, and the maximum load pressure detected by the higher-pressure select valve 33 is introduced to the pump regulator 32 through a pilot line 34 in such a manner as to act in opposite relation to the delivery pressure of the hydraulic pump 10 introduced to the pump regulator 32 through a pilot line 35. The pump delivery rate is thereby controlled to increase when the differential pressure between the maximum load pressure and the delivery pressure becomes smaller than a setting value, and decrease when it becomes larger than the setting value, so that the delivery pressure is always held higher by the setting value than the maximum load pressure. As a result, in case of an operation not causing the delivery rate of the hydraulic pump 10 to saturate, e.g., in a sole operation of the arm 3, the hydraulic pump 10 delivers the hydraulic fluid at a flow rate Qp substantially equal to one resulted from subtracting a recovered flow rate (described later) from the aforesaid flow rate Q11 passing through the flow control valve 11.

Relief valves 36, 37 are respectively disposed in the work lines 24, 25 for setting a maximum pressure of the circuit.

As a specific arrangement, this embodiment further includes a recovery circuit 40 for returning at least part of the hydraulic fluid discharged from the arm cylinder 4 to the supply line 23 at a portion between the pressure compensating valve 17 and the flow control valve 11 for recovering the discharged flow rate, during the mode in which the discharged flow rate is controlled by the first meter-out variable restrictor 21 of the flow control valve 11. The recovery circuit 40 comprises a third meter-out variable restrictor 41 disposed in the first return line 26 at a portion downstream of the flow control valve 11, a recovery line 42 having one end connected to the first return line 26 at a portion between the flow control valve 11 and the variable resistor 41, and the other end connected to the supply line 23 at a portion between the check valve 13 and the flow control valve 11, and a check valve 43 disposed in the recovery line 42 to allow only a flow of the hydraulic fluid directed from the return line 26 toward the supply line 23. As indicated by the character A, the variable restrictor 41 is so constructed as to change its amount of restriction dependent upon the input amount of the flow control valve 11 shifted upon application of the pilot pressure A.

Figure 2:
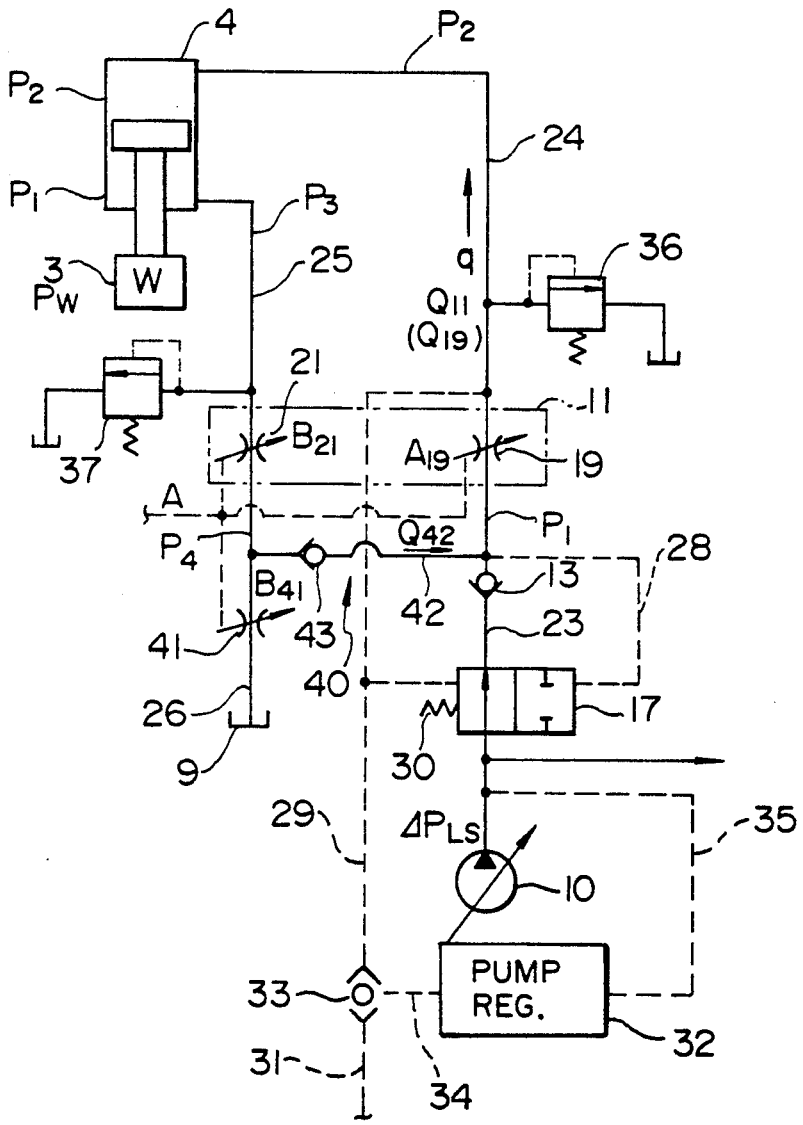
FIG. 2 is a schematic hydraulic circuit diagram showing, in the abridged form, a primary function of the hydraulic drive system of FIG. 1.

For easy understanding of the arrangement of the recovery circuit 40, only the flow control function to be carried out by the flow control valve 11 at a right-hand shift position on the drawing is picked up and shown in FIG. 2 in the form of simplified circuit arrangement.

Figure 3:
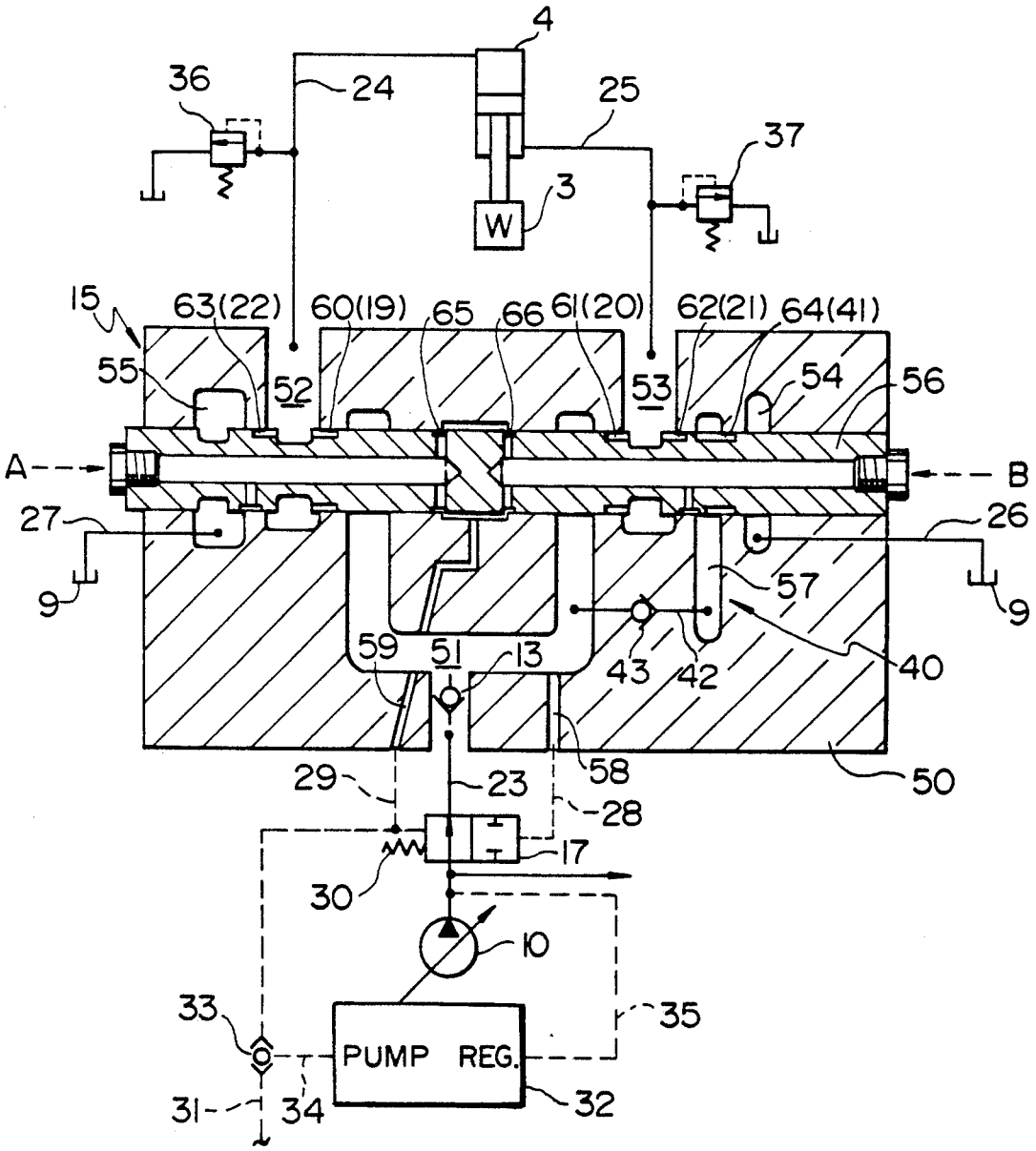
FIGS. 3 and 4 are sectional views showing the practical structure of a valve apparatus in the hydraulic drive system of FIG. 1.

FIG. 3 shows the practical structure of the valve apparatus 15 in which the recovery circuit 40 is integrally incorporated in the flow control valve 11.

In FIG. 3, the valve apparatus 15 has a valve case 50 in which there are defined an inlet passage 51, work passages 52, 53, and discharge passages 54, 55. Mutual communications between those passages are selectively changed over by a spool 56 slidably inserted into the valve case 50 in a fluid-tight sealing manner. The valve case 50 also has defined therein a recovery passage 57 of which the communication with the work passage 53 and the return passage 54 is changed over upon movement of the spool 56, a signal passage 58 connected to the inlet passage 51, and a signal passage 59 selectively communicating with the work passage 52 or 53 upon movement of the spool 56. The inlet passage 51 constitutes part of the supply line 23, the work passages 52, 53 constitute parts of the work lines 24, 25, the return passages 54, 55 constitute parts of the return lines 26, 27, and the recovery passage 57 constitutes part of the recovery line 42, respectively. Moreover, the signal passage 58 constitutes part of the pilot line 28 and the signal passage 59 constitutes part of the load line 29.

The spool 56 is formed with first and second metering slots 60, 61 for meter-in control, first and second metering slots 62, 63 for meter-out control, and a third metering slot 64 for meter-out and recovery control. The metering slots 60, 61 cooperate with corresponding adjacent wall portions of the inlet passage 51 to constitute the first and second meter-in variable restrictors 19, 20, the metering slots 62, 63 cooperate with corresponding adjacent wall portions of the recovery passage 57 and the return passage 55 to constitute the first and second meter-out variable restrictors 21, 22, and the metering slot 64 cooperates with a corresponding adjacent wall portion of the return passage 54 to constitute the third meter-out variable restrictor 41, respectively. The spool 56 is also formed with signal slots 65, 66 for selectively communicating the signal passage 59 with the work passage 52 or 53 upon movement of the spool 56.

Figure 4:
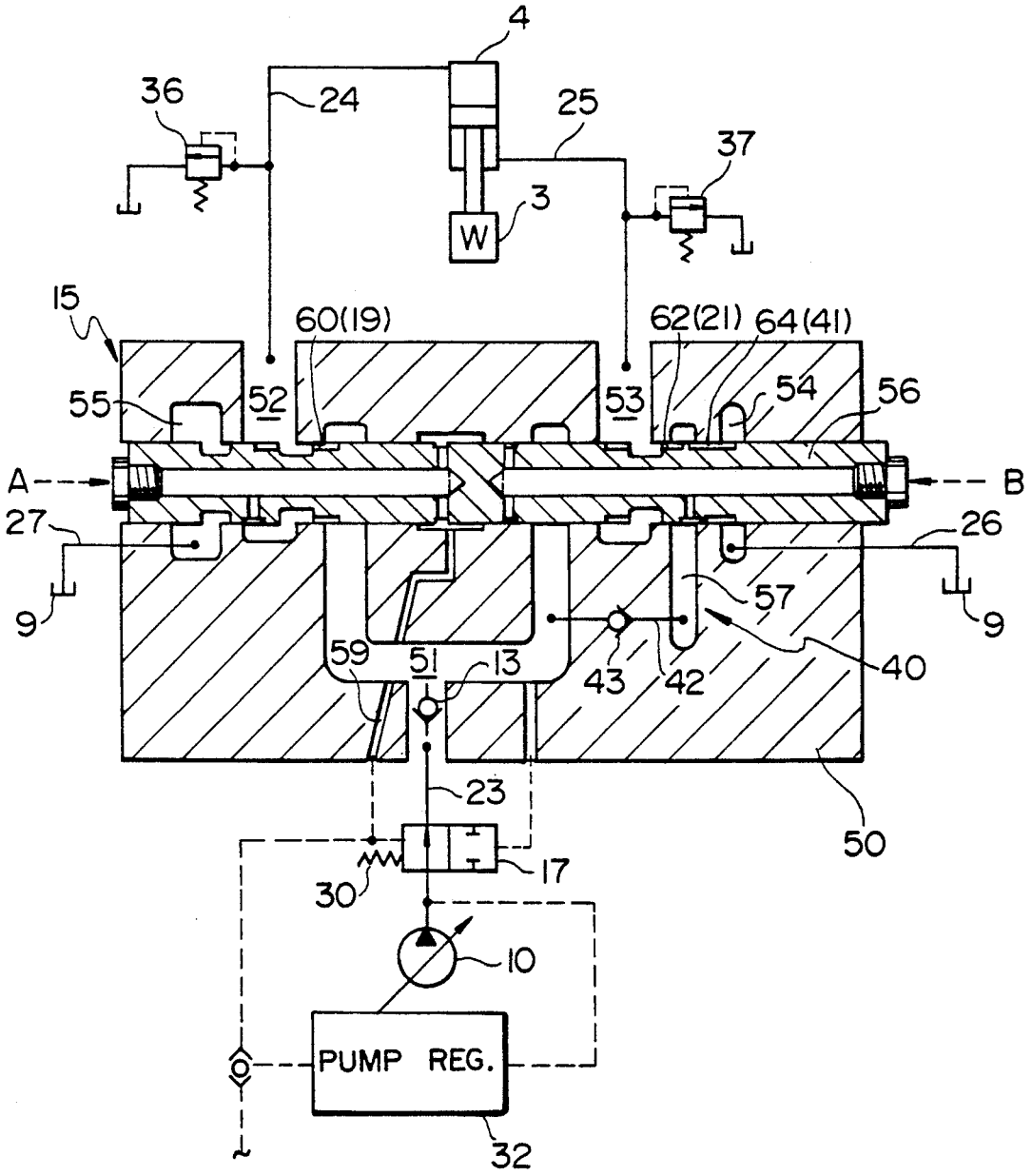

FIG. 4 shows the valve apparatus 15 of FIG. 3 in a state that the spool 56 is shifted by the pilot pressure A.

Figure 5:
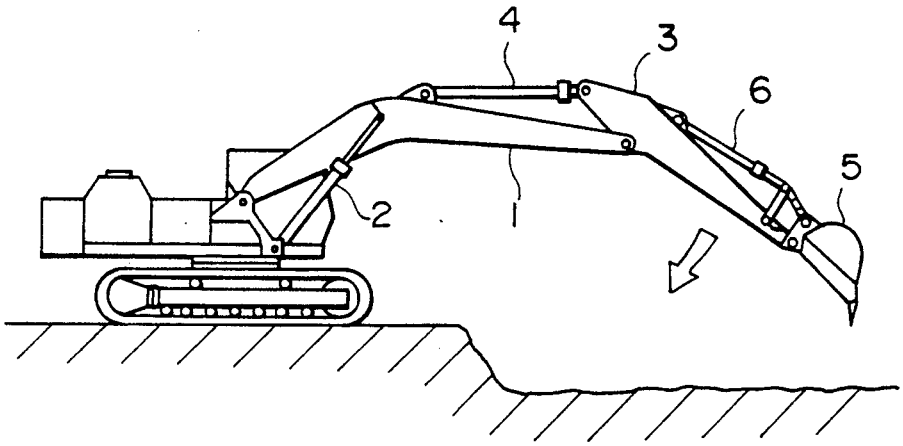
FIGS. 5 and 6 are illustrations showing a hydraulic excavator incorporating the hydraulic drive system of this embodiment, and for explaining practical examples of meter-out control and meter-in control of the hydraulic excavator.
Figure 6:
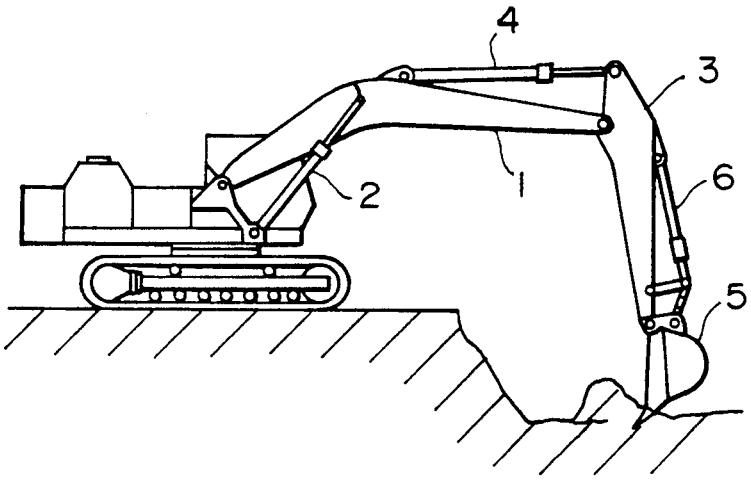

FIGS. 5 and 6 show, in different states of operation, an entire arrangement of the hydraulic excavator equipped with the hydraulic drive system of this embodiment. The hydraulic excavator includes a front attachment comprising the boom 1 pivotally mounted on an excavator body and driven by the boom cylinder 2, the arm 3 pivotally mounted to the distal end of the boom 1 and driven by the arm cylinder 4, and a bucket 5 pivotally mounted to the distal end of the arm 3 and driven by a bucket cylinder 6.

Operation of this embodiment will be described below. First, practical examples of meter-in control and meter-out control according to the operation of this embodiment will be explained with reference to FIGS. 5 and 6.

In FIG. 5, the arm 3 is about to descend in the direction of gravity in an arm crowding operation. At this time, the flow control valve 11 of the valve apparatus 15 associated with the arm cylinder 4 is shifted to the right-hand position on the drawing in FIG. 1 by the pilot pressure A. In this position, the flow rate of the hydraulic fluid returned to the reservoir 9 from the rod chamber **4*b* of the arm cylinder 4 is controlled dependent on the opening of the first meter-out variable restrictor 21, thereby controlling a descending speed of the arm 3. Thus, the descending speed of the arm 3 is placed under the meter-out control by the variable restrictor 21**.

Meanwhile, FIG. 6 shows a state where the arm is crowded for digging. At this time, the flow control valve 11 of the valve apparatus 15 is similarly shifted to the righthand position of the drawing in FIG. 1 by the pilot pressure A. In this position, the flow rate of the hydraulic fluid supplied from the hydraulic pump 10 to the bottom chamber **4*a* of the arm cylinder 4 is controlled dependent on the opening of the first meter-in variable restrictor 19, thereby controlling a drive speed of the arm cylinder 4. Thus, the drive speed of the arm 3 is placed under the meter-in control by the variable restrictor 19**.

In this embodiment, the meter-in control is carried out in a like manner to the prior art. More specifically, during the meter-in control mode, because the pressure in the supply line 23 is higher than the pressure in the return line 26, the check valve 43 of the recovery circuit 40 remains closed and the pressure compensating valve 17 operates so as to hold almost constant the differential pressure across the meter-in variable restrictor 19 which is opened upon application of the pilot pressure A to the flow control valve 11. Assuming now that the opening area of the variable restrictor 19 is A19 and the differential pressure is ΔPA, a flow rate Q19 of the hydraulic fluid passing through the meter-in variable restrictor 19 is expressed by:

$$Q19 = K \cdot A19 \cdot \sqrt{\Delta PA} \quad (K;\ \text{constant})$$

Thus, the passing flow rate Q19 is proportional to the variable restrictor's opening A19. Consequently, the arm cylinder 4 is driven in the direction of extension at a speed dependent on the opening of the variable restrictor 19.

In addition, since the hydraulic pump 10 is subjected to the load sensing control by the pump regulator 32 at this time, the hydraulic pump 10 delivers the hydraulic fluid at a flow rate substantially equal to the above passing flow rate Q19 in an operation region where the delivery rate of the hydraulic pump 10 will not be saturated. Thus, the pump delivery rate Qp is controlled to hold Qp=Q19.

During the meter-out control mode, e.g., when the arm descends in the direction of gravity, the hydraulic fluid in the rod chamber **4*b* of the arm cylinder 4 is discharged by the action of arm weight (dead load) W. After passing through the first meter-out variable restrictor 21, the flow rate of the discharged hydraulic fluid comes under control of the third meter-out variable restrictor 41 of the recovery circuit 40, whereupon one part of the hydraulic fluid passes through the third variable restrictor 41 to be discharged into the reservoir 9, while the other part passes through the recovery line 42 and the check valve 43 to flow into the supply line 23. With the hydraulic fluid flowing in this way, the pressure of the hydraulic fluid discharged from the rod chamber 4*b* of the arm cylinder 4 is regulated primarily by the first variable restrictor 21 and secondarily by the third variable restrictor 41 to control an extension speed of the arm cylinder 4, i.e., a descending speed of the arm 3**.

Then, the hydraulic fluid flowing into the supply line 23 is joined with the hydraulic fluid from the hydraulic pump 10 after passing through the pressure compensating valve 17, and the joined hydraulic fluid is supplied to the bottom chamber **4*a* of the arm cylinder 4 through the first meter-in variable restrictor 19**.

Assuming now that the flow rate of the hydraulic fluid passing through the recovery line 42 for the purpose of recovery is Q42 and also the flow rate passing through the variable restrictor 19 is Q19 like the above, the pump flow rate Qp required for producing the differential pressure ΔPA across the meter-in variable restrictor 19 is expressed by:

$$Qp = Q19 - Q42$$

Accordingly, the hydraulic horsepower necessitated in this case is given by:

$$PpQp = Pp(Q19 - Q42) < PpQ19$$

Thus, consumption energy is reduced by an amount corresponding to PpQ42 as compared with the hydraulic horsepower PpQ19 required for the case of producing no recovered flow rate. Since the pump delivery rate consumed by the arm cylinder 4 is also reduced, it is possible to supply the hydraulic fluid to the boom cylinder 2 at a sufficient flow rate even during combined operation of the boom 1 and the arm 2 in which the load pressure of the arm cylinder 4 becomes lower than that of the arm cylinder 2. In other words, the delivery rate of the hydraulic pump 10 is less likely to reach saturation and operability in the combined operation is improved, which implies effective solution of the saturation known as one problem in the load sensing control.

In this embodiment, the third variable restrictor 41 of the recovery circuit is disposed in the return line 26 at the portion downstream of the first variable restrictor 21 of the flow control valve 11, and the recovery line 42 is connected to the return line 26 at the portion between the first variable restrictor 21 and the third variable restrictor 41. With such an arrangment, the recovery line 42 is connected to the rod chamber **4*b* of the arm cylinder 4 through the first variable restrictor 21 so that the recovery line 42 is not subjected to the discharge pressure of the arm cylinder 4 directly, but the pressure lowered after passing through the first variable restrictor 21. Therefore, when the flow control valve 11 is finely operated to move the load in a very small amount during the meter-out control mode, the pressure upstream of the first variable restrictor 19 will not be raised excessively in spite of a reduction in the opening of the first meter-in variable restrictor 19, making it possible to properly operate the pressure compensating valve 17. Stated otherwise, the pressure compensating valve 17** is prevented from being closed unlike the conventional recovery circuit in which the discharge pressure of an actuator is returned to directly act on the a recovery line, and thus part of the flow rate of the discharged hydraulic fluid can be recovered without causing cavitation.

Furthermore, in this embodiment, the third variable restrictor 41 of the recovery circuit 40 is changed in its restriction amount in combined relation to the flow control valve 11. With such an arrangement, when the flow control valve 11 is finely operated during the meter-out control mode, the opening of the third meter-out variable restrictor 41 is reduced as with the openings of the first meter-in variable restrictor 19 and the first meter-out variable restrictor 21. This combined action of the third variable restrictor 41 reliably ensures the recovery pressure necessary for recovery function.

More specifically, supposing the opening of the third variable restrictor 41 be fixed, because the opening of this fixed restrictor is so set as to provide a proper recovery pressure in ordinary operation, the opening of the first variable restrictor 21 would be smaller than that of the fixed restrictor in fine operation of the flow control valve 11, rendering the fixed restrictor to fail in functioning as a restrictor. Thus, the pressure necessary for recovery could not be produced in the return line 26 between the first variable restrictor 21 and the fixed restrictor.

In contrast, with the opening of the third variable restrictor 41 reduced dependent upon the opening of the first variable restrictor 21 in this embodiment, the third variable restrictor 41 surely functions to throttle the hydraulic fluid after passing through the first variable restrictor 21. The pressure in the return line 26 between the first variable restrictor 21 and the third variable restrictor 41 is controlled such that it will not be lower than the pressure in the supply line 23 upstream of the flow control valve 11. Thus, the third variable restrictor 41 reliably functions as a restrictor regardless of the operation amount of the flow control valve 11, and ensures the adequate recovery pressure at all times.

With this embodiment, as explained above, the pressure compensating valve 17 can be properly operated and the adequate recovery pressure is ensured even in the fine operation of the flow control valve 11 to thereby recover the flow rate of the discharged hydraulic fluid without causing cavitation.

Operation of the foregoing recovery circuit 40 of this embodiment will now be described in more detail with reference to FIG. 2 by citing practical numerical values.

To begin with, the formula for determining the pressure in the work line 24 during the meter-out control mode is derived. Variables used in calculating the pressure are denoted by respective symbols below:

P1 . . . pressure in the supply line 23 upstream of the variable restrictor 19

P2 . . . pressure downstream of the variable restrictor 19, i.e., pressure in the work line 24

P3 . . . pressure upstream of the variable restrictor 21, i.e., pressure in the work line 25

P4 . . . pressure between the variable restrictors 21 and 41, i.e., recovery pressure PW . . . pressure corresponding to weight of the load W, i.e., holding pressure ΔPLS . . . differential pressure to be compensated by the pressure compensating valve 17

α . . . area ratio between the bottom chamber **4*a* and the rod chamber 4*b* of the arm cylinder 4**

A19 . . . opening of the variable restrictor 19

B21 . . . opening of the variable restrictor 21

B41 . . . opening of the variable restrictor 41 q . . . flow rate passing through the variable restrictor 19

ρ . . . density of the hydraulic fluid

First, the differential pressure across the variable restrictor 19 is compensated by the pressure compensating valve 17, resulting in the following equation:

$$P1 = P2 + \Delta PLS \quad (1)$$

From the balance of forces acting on the arm cylinder 4, there holds the relationship below:

$$P3 = \alpha P2 + PW \quad (2)$$

The presence of the recovery line 42 leads to:

$$P4 = P1 \quad (3)$$

The pressure loss dependent on the opening B21 of the variable restrictor 21 leads to:

$$P3 - P4 = \frac{1}{2}\rho\left(\frac{q/\alpha}{B21}\right)^2 = \frac{1}{2}\rho\left(\frac{q}{B21}\right)^2\frac{1}{\alpha^2} \quad (4)$$

The flow rate passing through the meter-in variable resistor 19 leads to:

$$\Delta PLS = \frac{1}{2}\rho\left(\frac{q}{A19}\right)^2 \quad (5)$$

From the above equations (1) through (5), P2 is given by:

$$P2 = \frac{1}{\alpha - 1}\left(\left\{\left(\frac{A19}{B21\alpha}\right)^2 + 1\right\}\Delta PLS - PW\right) \quad (6)$$

It is found from the equation (6) that cavitation will not be caused under the condition of P2>0 and, therefore, the recovery function can be provided with no possibility of cavitation by setting such metering characteristics as to always keep the ratio of B21 to A19 above a certain value.

Assuming that the holding pressure PW=50 kg/cm$^2$, the area ratio $\alpha=2$, the compensated differential pressure ΔPLS=10 kg/cm$^2$ and A19/B21=5, P2=22.5 kg/cm$^2$ is obtained from the equation (6). In this case, the values of the other variables are given as follows; P1=32.5 kg/cm$^2$, P3=95 kg/cm$^2$, P4=32.5 kg/cm$^2$ and P3−P4=62.5 kg/cm$^2$.

If the load is changed into PW=60 kg/cm$^2$, P2=12.5 kg/cm$^2$ is determined from the equation (6) along with P1=22.5 kg/cm$^2$, P3=85 kg/cm$^2$, P4=22.5 kg/cm$^2$ and P3−P4=62.5 kg/cm$^2$.

It is thus understood that even if the load is changed, the pressure P2 will be held positive and the cavitation will not be caused. It is also understood that the differential pressure across the meter-out variable resistor 21 remains fixed and, consequently, the descending speed of the arm will be held constant even if the load is changed.

Moreover, in this embodiment, the recovery line 42 is located at the portion downstream of the flow control valve 11, so that its communication with the rod chamber **4*b* of the arm cylinder 4 is blocked off by the flow control valve 11 when the flow control valve 11 is in a neutral position. Accordingly, when the arm cylinder 4 is contracted to lift up a heavy object and the flow control valve 11 is then returned to the neutral position to hold the heavy object at a certain level, the load pressure in the rod chamber 4*b* of the arm cylinder will not act on the port of the flow control valve 11 on the same side as the supply line 23, i.e., the supply port. This is in contrast with the arrangement of JP, A, 63-83808 cited above as the prior art wherein the load pressure in the rod chamber 4*b*** of the arm cylinder directly acts on a supply port of a flow control valve. With that prior arrangement leading the load pressure to directly act on the supply port of the flow control valve, a leak amount of the hydraulic fluid within the flow control valve is increased when the flow control valve is in the neutral position, making it difficult to hold the heavy object at a desired level. On the contrary, since this embodiment does not accompany such a problem of increasing the leak amount within the flow control valve, the heavy object can be easily held at a desired level and the safety during operation can be improved.

With this embodiment, as explained above, by allowing the pressure compensating valve 17 to properly operate by the second variable restrictor 21 and securing the adequate recovery pressure by the third variable resistor 41, it is possible to recover the flow rate of the discharged hydraulic fluid without causing cavitation, and thus unite smooth operation and energy saving.

Further, with this embodiment, since the load pressure in the rod chamber **4*b* of the arm cylinder will not act on the supply port of the flow control valve 11 when the flow control valve 11** is in the neutral position, the leak amount of the hydraulic fluid within the flow control valve can be prevented from increasing, with the results of easily holding the heavy object at a desired level and improving the safety during operation.

In addition, with this embodiment, although there is a problem of the hydraulic pump 10 undergoing saturation in the case where the hydraulic pump 10 is of the variable displacement type and subjected to the load to the load sensing control, the hydraulic pump 10 less likely to undergo saturation by recovery of the flow rate of the discharged hydraulic fluid. It is thus possible to improve operability in the combined operation, while securing high economic efficiency due to the load sensing control.

Also, with this embodiment, since the third variable restrictor 41 of the recovery circuit 40 is provided integrally with the variable restrictors 19 through 22 of the flow control valve 11 and is incorporated into the valve apparatus 15 together as shown in FIGS. 3 and 4, the arrangement allowing the variable restrictor 41 to be operated dependent upon the operation amount of the flow control valve 11 can be easily realized and the valve structure can be compacted.

While in the foregoing embodiment the hydraulic pump 10 is disclosed as being of the variable displacement type and subjected to the load sensing control, the present invention is not limited to this type of hydraulic pump and control means. Another type of hydraulic supply source may have a hydraulic pump of the fixed displacement type and an unloading valve so disposed as to control the pump delivery pressure to be higher by a fixed value than the load pressure of an actuator, for example. In this way the similar advantageous effect can be provided by recovering the flow rate of the discharged hydraulic fluid in an operating state wherein the delivery rate of the hydraulic pump is insufficient.

According to the present invention, the pressure compensating valve is properly operated and the adequate recovery pressure is ensured, thereby enabling it to recover the flow rate of the discharged hydraulic fluid without causing cavitation, so that both smooth operation and energy saving are achieved.

With the recovery line branched from the return line downstream of the second variable restrictor of the flow control valve, the load pressure of the actuator will not act on the supply port of the flow control valve when the flow control valve is in the neutral position. Consequently, the leakage leak amount of the hydraulic fluid within the flow control valve can be prevented from increasing, making it possible to easily hold the heavy object at a desired level and improve the safety during operation.

In the case of the hydraulic pump being of a variable displacement type subjected to load sensing control, the saturation of the hydraulic pump is alleviated to improve operability in the combined operation, while securing high economic efficiency due to the load sensing control.

Finally, with the third variable restrictor of the recovery circuit incorporated integrally with the variable restrictors of the flow control valve, it is possible to easily realize the arrangement which allows the variable restrictor to be operated dependent upon the input amount of the flow control valve 11, thus making the valve structure more compact.

What is claimed is:

1. A hydraulic drive system comprising a hydraulic pump, a reservoir, at least one hydraulic actuator, a hydraulic fluid supply line connected to said hydraulic fluid supply source, a hydraulic fluid return line connected to said reservoir, a flow control valve having a first variable restrictor to control a flow rate of a hydraulic actuator and a second variable restrictor to control a flow rate of the hydraulic fluid discharged from said hydraulic actuator to said return line, a pressure compensating valve disposed in said supply line to hold constant a differential pressure across said first variable restrictor, and a recovery circuit including a recovery line having a check valve allowing only a flow of the hydraulic fluid toward said supply line, for receiving at least part of the hydraulic fluid discharged from said hydraulic actuator and returning it to said supply line at a portion between said pressure compensating valve and said first variable restrictor upon controlling of the discharged flow rate by said second variable restrictor to thereby recover the discharged hydraulic fluid, wherein said recovery circuit further includes a third variable restrictor for controlling a recovery pressure of the hydraulic fluid returned to said supply line, and means for controlling an amount of restriction of said third variable restrictor dependent upon an input amount of said flow control valve in such a manner that an opening degree of said third variable restrictor increases as opening degrees of said first and second variable restrictors increase and the opening degree of said third variable restrictor decreases as the opening degrees of said first and second variable restrictors decrease;

wherein said third variable restrictor is disposed in said return line at a portion downstream of said second variable restrictor, and said recovery line is connected to said return line at a portion between said second variable restrictor and said third variable restrictor.

2. A hydraulic drive system according to claim 1, wherein said third variable restrictor is formed in a spool of said flow control valve along with said first variable restrictor and said second variable restrictor.

3. A hydraulic drive system according to claim 1, wherein said hydraulic pump is of the variable displacement type, and said hydraulic fluid supply source includes a load sensing regulator for controlling a delivery rate of said hydraulic pump such that a delivery pressure of said hydraulic pump is held higher by a fixed valve than a load pressure of said hydraulic actuator.

* * * * *